US009957685B2

(12) United States Patent
Yackley

(10) Patent No.: US 9,957,685 B2
(45) Date of Patent: May 1, 2018

(54) METHOD AND APPARATUS FOR PORTABLE STAKE MOUNTING

(71) Applicant: Robert T. Yackley, Plainfield, IL (US)

(72) Inventor: Robert T. Yackley, Plainfield, IL (US)

( * ) Notice: Subject to any disclaimer, the term of this patent is extended or adjusted under 35 U.S.C. 154(b) by 0 days. days.

(21) Appl. No.: 14/818,088

(22) Filed: Aug. 4, 2015

(65) Prior Publication Data

US 2016/0032551 A1 Feb. 4, 2016

Related U.S. Application Data

(60) Provisional application No. 62/033,024, filed on Aug. 4, 2014, provisional application No. 62/038,744, filed on Aug. 18, 2014.

(51) Int. Cl.
*E02D 5/74* (2006.01)
*E02D 5/80* (2006.01)

(52) U.S. Cl.
CPC ..... *E02D 5/80* (2013.01); *E02D 5/801* (2013.01)

(58) Field of Classification Search
CPC E02D 5/80; E02D 5/801; E02D 5/803; E02D 2200/1671; E04H 12/2215; E04H 12/2223; E04H 12/2269; E04H 17/08; A01K 1/04
USPC ..... 52/156
See application file for complete search history.

(56) References Cited

U.S. PATENT DOCUMENTS

| | | | | |
|---|---|---|---|---|
| 187,337 | A * | 2/1877 | Wing et al. | E04H 12/2215 52/154 |
| 254,662 | A * | 3/1882 | Kinney | E02D 5/80 256/56 |
| 289,033 | A | 11/1883 | Shattuck | |
| 429,111 | A | 6/1890 | Bailey | |
| 608,753 | A * | 8/1898 | Carr | E02D 5/80 52/166 |
| 897,787 | A * | 9/1908 | Ryan | E02D 5/80 248/87 |
| 903,944 | A * | 11/1908 | Andersen | E02D 5/80 52/156 |
| 911,504 | A * | 2/1909 | Jay | E02D 5/80 119/780 |
| 2,525,890 | A | 7/1949 | Gage | |
| 2,713,327 | A | 10/1953 | West | |
| 2,790,419 | A | 4/1956 | Sullivan | |
| 2,799,369 | A * | 7/1957 | Walton | E04H 17/08 52/151 |

(Continued)

OTHER PUBLICATIONS

Definition of "auger" found on Merriam-Webster dictionary at: https://www.merriam-webster.com/dictionary/auger.*

*Primary Examiner* — Brian D Mattei
(74) *Attorney, Agent, or Firm* — Erickson Law Group, PC

(57) ABSTRACT

A stake assembly provides an earth anchor and includes a stake having a longitudinal axis and an upper portion and a lower portion. The stake is attached to a cup having a sidewall defining a closed perimeter and a top wall substantially closing the sidewall, the sidewall having an open bottom end. The stake passes through the top wall with the upper portion above the top wall and the lower portion below the top wall. When the stake is pounded or screwed into the ground the cup captures soil which adds resistance to the stake being removed from the ground. One embodiment has the cup at an oblique angle to the top wall.

2 Claims, 6 Drawing Sheets

(56) References Cited

U.S. PATENT DOCUMENTS

| | | | | |
|---|---|---|---|---|
| 3,032,149 | A * | 5/1962 | Manghise | E04H 12/2215 52/156 |
| 3,840,203 | A * | 10/1974 | Sheehy | A63B 71/02 248/156 |
| 5,135,192 | A * | 8/1992 | Winkler | E04H 12/2223 248/156 |
| 6,128,867 | A * | 10/2000 | MacKarvich | E02D 5/801 52/155 |
| 6,272,798 | B1 * | 8/2001 | Cockman | E02D 5/801 135/118 |
| 6,810,630 | B2 | 11/2004 | Chizmas | |
| 8,919,060 | B1 * | 12/2014 | Oliver | E02D 27/48 405/230 |
| 8,950,222 | B1 * | 2/2015 | Bonnevie | E04H 13/003 135/118 |
| 2004/0231257 | A1 * | 11/2004 | Brown | E02D 5/801 52/292 |
| 2006/0051183 | A1 * | 3/2006 | Powell | E02D 5/801 411/386 |
| 2008/0307721 | A1 * | 12/2008 | Schultz | E02D 5/801 52/157 |
| 2014/0020310 | A1 * | 1/2014 | Lee | E02D 7/22 52/157 |

* cited by examiner

Fig. 1
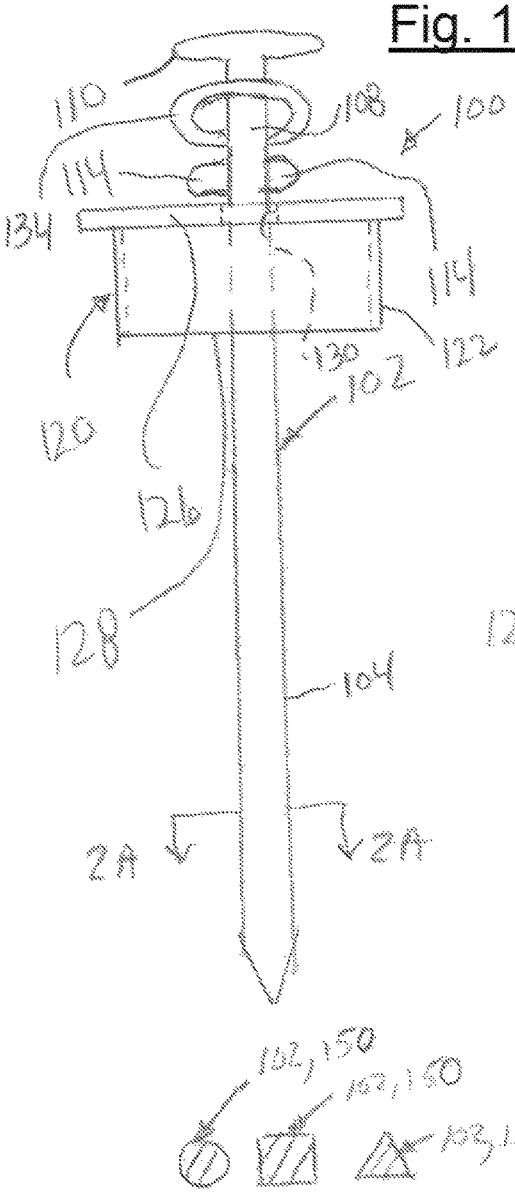
Fig. 2
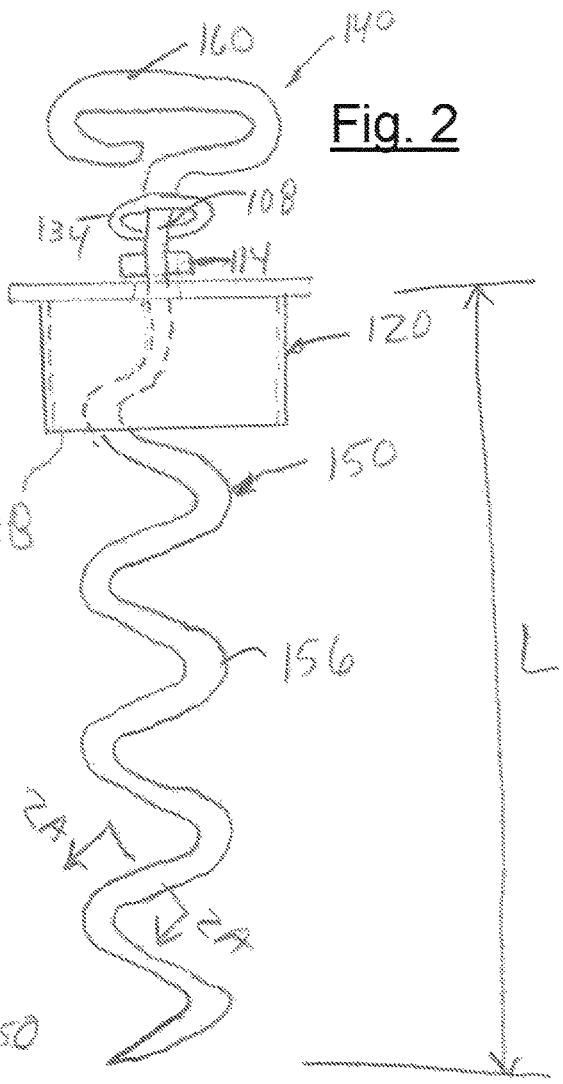
FIG. 2A

METHOD AND APPARATUS FOR PORTABLE STAKE MOUNTING

This application claims the benefit of U.S. Provisional Application 62/033,024, filed Aug. 4, 2014, and U.S. Provisional Application 62/038,744, filed Aug. 18, 2014.

FIELD OF INVENTION

This invention relates in general to portable stakes used for providing an earth anchor. This stakes can be used to tether a pet outdoors or for the purpose of staking trees to secure from movement, especially newly planted trees, or for adjusting the angle of a tree's growth.

BACKGROUND

When pets are left outside, it is often desired for pets to be tethered. A common means of tethering pets is to affix one end of a leash, rope, chain, wire, or other medium to the dog and the other end to a stake mounted into the ground. These stakes are commonly driven into the ground, either screwed in or driven in. The security of such stakes is determined by the several factors including the type of soil, the depth of the stake driven or screwed into the ground, and the ability for the ground to hold the stake from pulling out.

The present inventor has recognized a common problem with existing stakes is that they don't secure the top end of the stake from movement. The puffing on the stake by the dog attached to the leash and therefore attached to the stake, loosens the soil around the stake. As the soil loosens around the stake, it becomes increasingly more likely that the dog will pull the stake out of the ground, partially or completely. The problem associated with the dog puffing it completely out of the ground is the obvious loss of security. The problem associated with partially pulling the stake out of the ground is the increasing likelihood the dog may bend, damage, or break the stake. A worthwhile note is that the loosening of the stake is typically the result of horizontal forces on the stake, as opposed to vertical. Typically the stakes are inserted vertically, but as the dog pulls on the stake and loosens the ground, the stake begins to change its orientation toward a horizontal position, which is the direction of pull, again, allowing the stake to be more easily pulled loose and out of the ground.

The inventor recognizes the need to better secure the top portion of the stake to the ground, which is the end at the surface of the ground in order to prevent or minimize the ability of the stake to shift towards the horizontal by preventing or minimizing the loosening of the soil around the stake caused by the horizontal pulling from the dog.

When trees are planted, it is usually necessary, if not recommended, for a tree to be secured in place to prevent the wind from blowing the tree over and to insure the tree grows straight. Typically, when a tree is planted commercially or residentially, the most common method of staking a tree is to drive wooden stakes into the ground and tie one end of a rope to the stake and the other end to the tree. There are usually at least 3 stake/rope combinations to prevent movement in any direction. Other times, one stake would be used if the purpose is to adjust the tree's angle of growth in one direction.

Wooden stakes are usually driven into the ground with a sledge hammer. The stakes often loosen in the ground and the rope is not securely fastened as it is simply tied around the stake, which allows the possibility of the rope to slide off the top of the stake.

The present inventor has recognized the need for a portable and secure staking method that is simple to install.

SUMMARY

An exemplary embodiment of the invention comprises a stake assembly that has two parts: a stake and a "cup." The stake may be a typical stake shape, spiral or straight, that are currently in the market place. The cup is inverted and is engaged with the shaft and is driven into the ground, capturing a large portion of the earth, or ground, to significantly reduce the ability of the shaft to move back and forth, loosen up, and then be pulled from the ground.

In one embodiment, the present disclosure provides a spiral stake consisting of a metal (or other durable material) shaft, formed in a spiral for the portion of the stake that is screwed into the ground. The other end of the metal stake includes a straight vertical section immediately above the spiral. Above the spiral section is a formed loop that can be used both as a handle for screwing the stake into the ground by hand, or to accept a device such as a screwdriver, pry bar, or other device to provide leverage to assist in screwing into the ground. In another embodiment, the stake is straight. In this second embodiment, the looped top end of the stake is replaced with a flattened head such that a hammer can be used to pound on this flattened surface to drive the stake into the ground.

The straight section of the shaft can have a raised portion, either formed by "stamping" the metal which displaces some of the metal to create a raised surface or surfaces, or formed by welding a raised surface, or other means to create the raised portion. The purpose of this surface is to create a physical barrier to act as a stop to an inverted metal, plastic, or other material cup structure. This inverted cup may include a round flat component, plus a hollow tube affixed to the underside by various means including, but not limited to gluing, welding, or formed together as one piece.

The aforementioned cup provides holding properties by significantly increasing the difficulty to move the stake and reduces the ability of the stake to come loose in the ground. The cup has a center hole and fits over the shaft. Additionally, the cup is pushed into the ground, encapsulating a large portion of the soil, sand, clay, or other ground surface. By capturing a large portion of the soil, sand, clay, or other ground surface, the resistance to horizontal movement is significantly increased.

When the stake is driven, pounded or screwed into the ground, the cup is also driven into the ground and held in place by the raised element on the shaft. This keeps the cup in the ground but also keeps a portion of the straight shaft section above the ground.

When used to tether a dog, immediately above the cup and stop there may be a metal, or other material loop or swivel used to attach one end of the dog's leash to the stake. The loop or swivel fits loosely on the shaft in order to provide the ability for it to rotate 360 degrees.

For anchoring a stationary object, such as a newly planted tree, it may be beneficial to arrange the stake at an angle. An advantageous application would have the cup angled so that the force of the rope, which is typically between 30 and 55 degrees from the ground, is perpendicular to the axis of the cup. The angled orientation of the cup makes it very difficult to pull the assembly out of the ground. The diameter of the cup grabs a large plug of earth making it more secure from movement that a simple stake in the ground.

The aforementioned cup provides significant holding properties by increasing the difficulty to move the stake, therefore reducing the ability of the stake to come loose in the ground. The cup has a center hole and fits over the shaft. Additionally, the cup is pushed into the ground, typically on an angle so that the force pulling on the tree to the stake is approximately a 90 degree angle to the cup's angle, encapsulating a large portion of the soil, sand, clay, or other ground surface. By capturing a large portion of the soil, sand, clay, or other ground surface, the resistance to horizontal movement is significantly increased.

When the stake is driven, or screwed into the ground, the cup is also driven into the ground and held in place by the raised element on the shaft. This keeps the cup in the ground but also keeps a portion of the straight shaft section above the ground. A carabineer, or other loop device is affixed to the stake, above the cup, to attach a rope, wire or the like. The other end of the rope wire or the like is attached to the tree.

A further embodiment provides that the cup has a larger opening to pass the stake, even the spiral stake, without turning the stake, and a plug affixed to the stake that closes the larger opening and presses on the cup when the stake is pounded or screwed into the earth. The cup can have teeth on a bottom edge such that the cup can be rotated by hand to cut through vegetation or earth. Thus the cup can be at least partially forced into the earth before the stake is driven into the earth through the cup. The stake can be connected to the plug by the plug being molded around and over raised portions on the outside surface of the stake.

The stake assembly embodiments of the invention can have many uses including: to tether pets; to laterally support trees with wire or rope; to anchor tents; to anchor inflatable Christmas lawn ornaments; to anchor inflatable play houses, bouncy houses or slides that are rented for lawn parties, etc.

Numerous other advantages and features of the present invention will become readily apparent from the following detailed description of the invention and the embodiments thereof, from the claims and from the accompanying drawings.

BRIEF DESCRIPTION OF DRAWINGS

FIG. 1 is an elevation view of a stake assembly according to an embodiment of the invention;

FIG. 2 is an elevation view of a stake assembly according to another embodiment of the invention;

FIG. 2A is a sectional view taken along lines 2A-2A of FIGS. 1 and 2, showing three alternate cross sections for the stakes;

DETAILED DESCRIPTION

Figure 3:
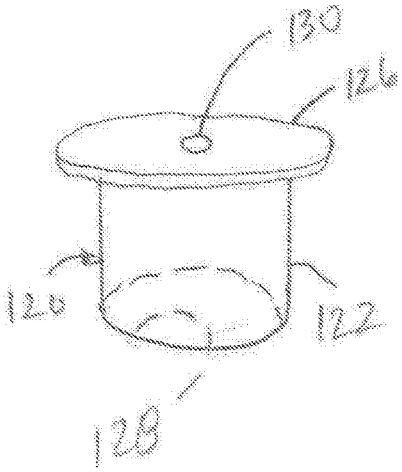
FIG. 3 is a perspective view of a cup portion of either embodiment of FIGS. 1 and 2.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

While this invention has different embodiments, other forms and shapes of the stake may be used that are similar in design. The drawings show plural embodiments, including one stake with a straight main shaft and another stake with a spiral or helical shaft. It should be noted that other shapes of the stake shaft could also be used. Additionally, the bottom side of the "cup" is shaped as a circle. The cup's underside and topside could take any geometrical shape and have similar function.

FIG. 1 shows a first embodiment of a stake assembly 100. A stake 102 is typically fabricated from metal, such as steel, but could be made from other durable materials. The stake 102 has a shaft portion 104 that is driven into the soil, sand, clay, or other earth surface. Towards the top of the stake 102, there is a straight section 108 and either a generally flat or domed head 110 providing an impact receiving surface for the stake 102 to be pounded into the ground with a hammer. On the shaft in the straight section 108, there is a raised surface forming a stop or side ears 114. Below the ears 114 is a cup 120 formed by a cylindrical sidewall 122 and closed on the top by a plate 126. The cylindrical sidewall has an open bottom end 128. The plate 126 includes a hole 130 for receiving the shaft portion 104 therethrough. The ears 114 extend laterally to an outside dimension greater than a diameter of the hole 130 to act as a stop to prevent the straight section from passing through the plate 126. The stop 114 can be formed by stamping the metal, welding a raised surface, or any other means to create a raised surface. Alternatively, a hole could be drilled into the shaft straight section 108 and a pin inserted to form a stop.

A ring, carabineer, openable chain link or other connector 134 is fit around the straight section 108 below the head 110. This connector can be engaged by a pet leash, wire, chain or other member that needs anchorage from the stake assembly 100.

FIG. 2 illustrates an alternate embodiment stake assembly 140. This embodiment is identical to the embodiment of FIG. 1 except that an alternate stake 150 is used. The stake 150 is has a helical shaft 156 that is intended to be screwed into the earth rather than being pounded into the earth. The stake 150 includes the straight section 108 and the stop 114 of FIG. 1. Instead of the head 110 of FIG. 1, the straight section 108 extends upward into a loop 160. The loop 160 is sized and shaped for a user to grip with a hand and rotate the stake to drive the helical shaft 156 into the earth. The loop 160 can receive a tool or bar to assist a user in rotating the stake.

FIG. 2A shows that the stakes 102, 150 can have alternate cross sections: round, square, triangular or any other sturdy cross section.

Figure 4:
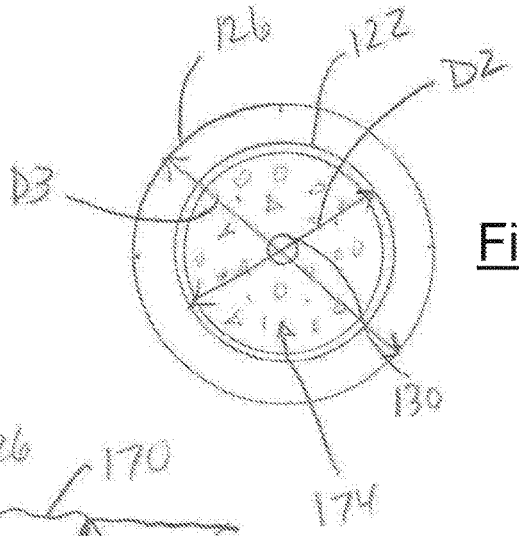
FIG. 4 is a bottom view of the cup portion of FIG. 3.

FIGS. 3 and 4 show an embodiment of the cup 120. The cup 120 may be one piece formed together or two pieces attached through welding, gluing, or other method of affixing two components together. Typically the cup is made from metal, but could be plastic, nylon, or any other durable material. The plate 126 can be a flat, round metal top. The cylinder 122 may have an outside diameter ranging from the diameter as wide of the plate 126 to as narrow as slightly larger than the diameter of the shaft 104, 156. FIG. 4 shows the underside of the cup 120 with the ground, 174 captured inside the tube.

For the embodiments of FIGS. 1 and 2, it is possible that the stake 102, 150 can be welded to the cup 120 at the plate 126 around the hole 130 and the stop 114 could be eliminated. In that case the cup and stake are driven or rotated as one unit. However, it may be easier to install the assembly if the hole 130 is larger than an outside dimension or diameter of the stake lower section 104, 156 such that the stake can be driven or screwed into the earth with freedom of movement with respect to the cup 120 and only impact the cup when the stop 114 reaches the plate 126.

Figure 5:
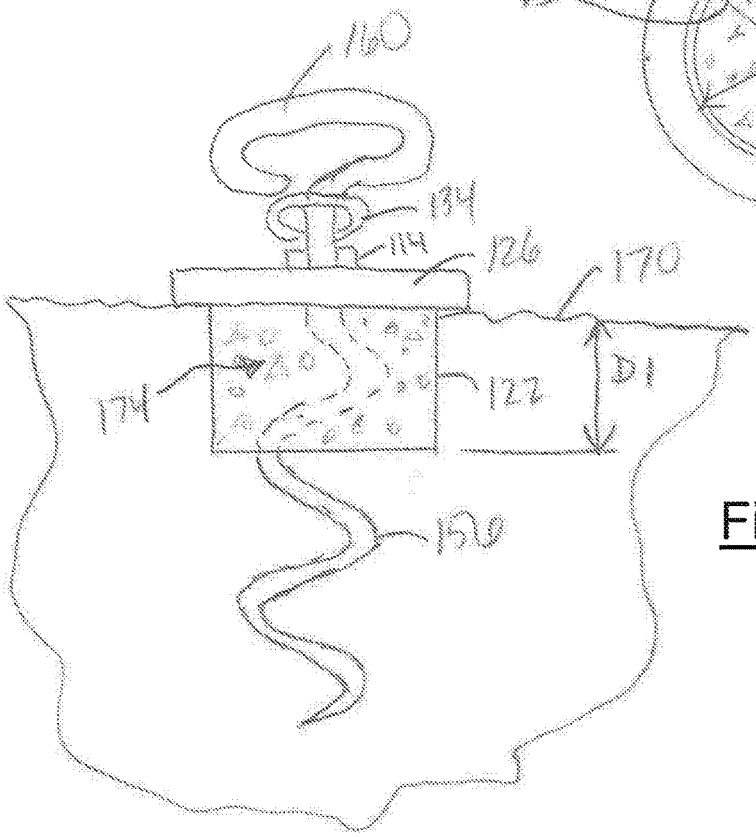
FIG. 5 is an elevation view of the embodiment of FIG. 2 as installed in the earth.

FIG. 5 shows the embodiment of FIG. 2 screwed into the earth. The assembly 100 or 140 is driven or screwed into the ground such that the cup's cylindrical wall 122 is under the ground surface 170 and the plate 126 is flush to the surface 170, while the stake is driven deep enough so the stop 114 is tight against the plate 126 holding it firmly in the ground. The cup 120 captures soil 174 within the cylindrical wall 122 beneath the plate 126, also shown in FIG. 4.

Figure 6:
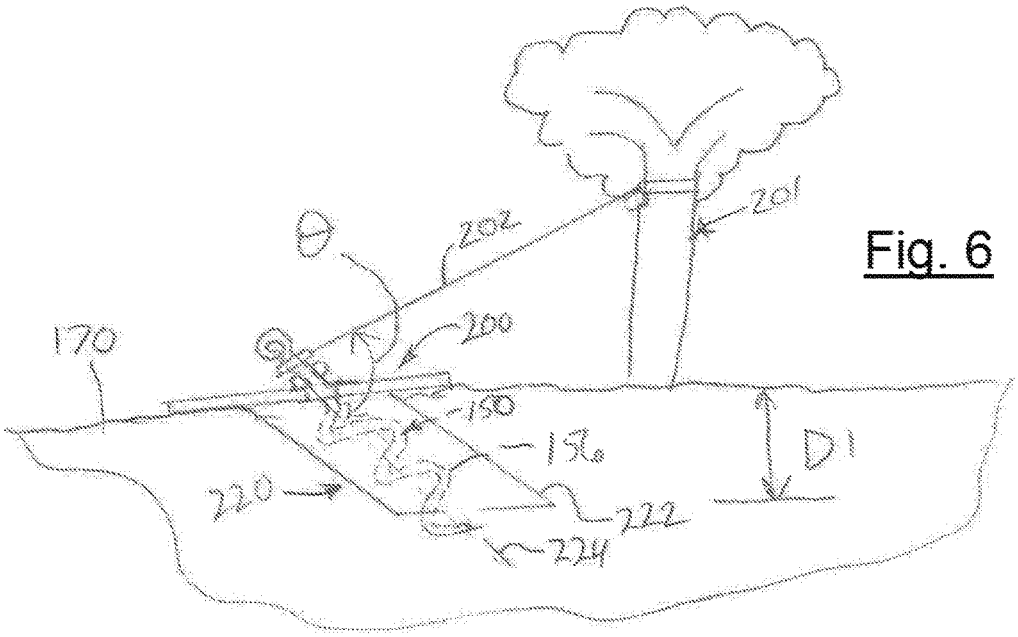
FIG. 6 is an elevation view of a stake assembly of a further embodiment of the invention, installed in the earth and supporting a tree.
Figure 7:
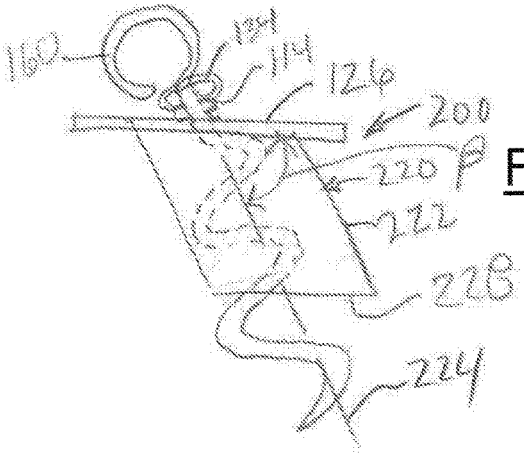
FIG. 7 is an enlarged elevation view taken from FIG. 6.
Figure 8:
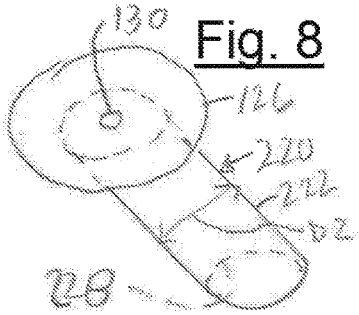
FIG. 8 is a perspective view of the stake assembly of FIG. 7 with portions removed to see underlying parts.

FIGS. 6-8 show another embodiment stake assembly 200 of the invention secured into the ground. In this illustration the stake assembly is supporting a tree 201 (not drawn to correct proportion compared to the illustrated size of the stake assembly) through a wire 202.

The stake assembly 200 is identical to the prior described embodiment of FIG. 2 except that the cup 120 is replaced by a cup 220 that has a cylindrical sidewall 222 that has a longitudinal axis 224 that is obliquely angled with respect to the plate 126. The sidewall 222 has an open bottom end 228 in a plane that is substantially parallel to the bottom surface of the plate 126. In FIG. 6, the plate 126 has a bottom side pushed flush to the ground 170 while the cup cylindrical sidewall 222 is pushed into the ground obliquely and secured in place by the spiral stake 150. As previously described, the stake fits through the hole 130 in the plate 126 and uses the stop 114 to press the plate 126.

According to an exemplary embodiment, the angle β (FIG. 7) between the axis 224 and the bottom surface of the plate 126 is about 35 degrees. For many applications, this will make the angle θ (FIG. 6) between the wire 202 and the axis 224 about 90 degrees. This will provide near the maximum pull-out resistance of the stake due to tensile force on the wire.

Figure 9:
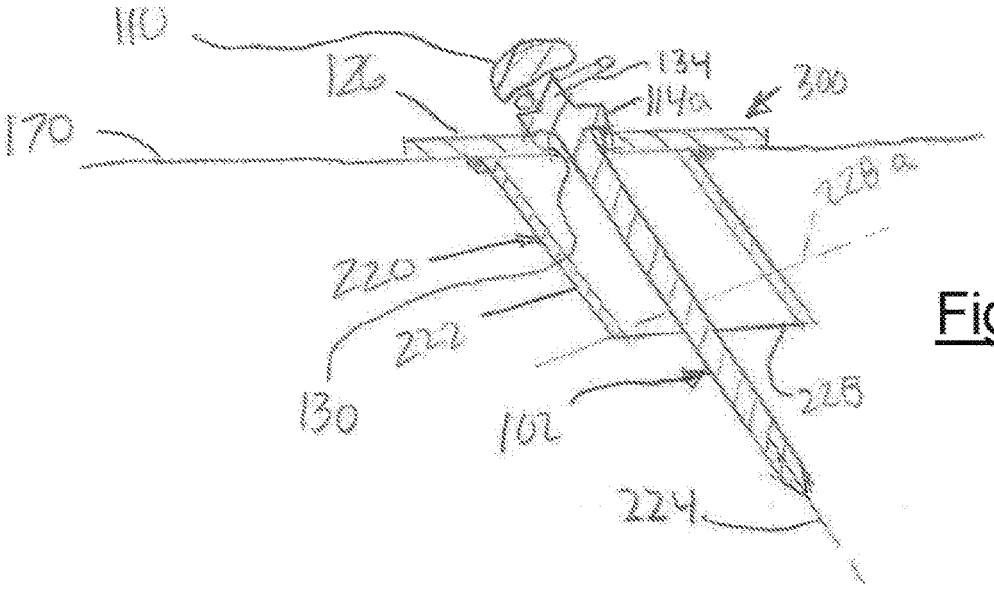
FIG. 9 is a sectional view of an alternate embodiment stake assembly.

FIG. 9 illustrates an alternate embodiment stake assembly 300 that uses the cup assembly 220 of FIGS. 6-8 with the plate 126 and the angled cylindrical sidewall 222, combined with the driven stake 102 as described in FIG. 1. The stake 102 of FIG. 1 can have modified ears 114*a* that are angled to be flush with the top plate 126 when the stake 102 is driven at an angle corresponding to the axis 224 of the cylindrical sidewall 222. Also, although the bottom open end 228 is shown parallel to the bottom surface of the plate 126, and the ground surface, it could be cut along the plane 228*a* to be perpendicular to the axis 224.

Figure 10:
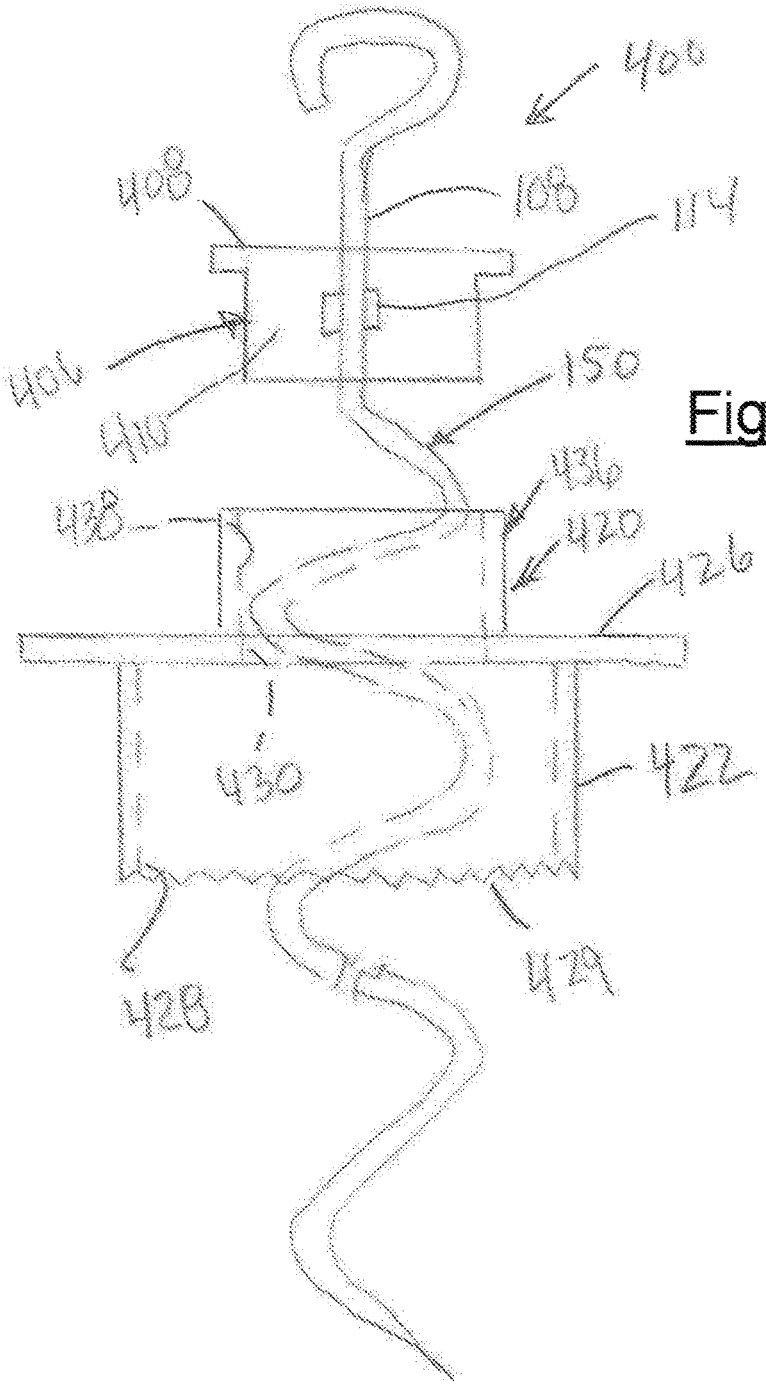
FIG. 10 is an elevation view of a further embodiment stake assembly in a first position.
Figure 12:
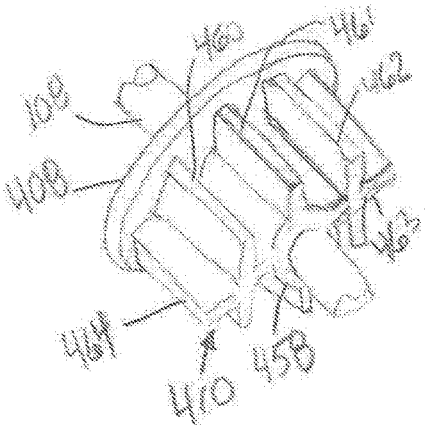
FIG. 12 is a perspective view of an embodiment of the plug taken from FIG. 10.
Figure 11:
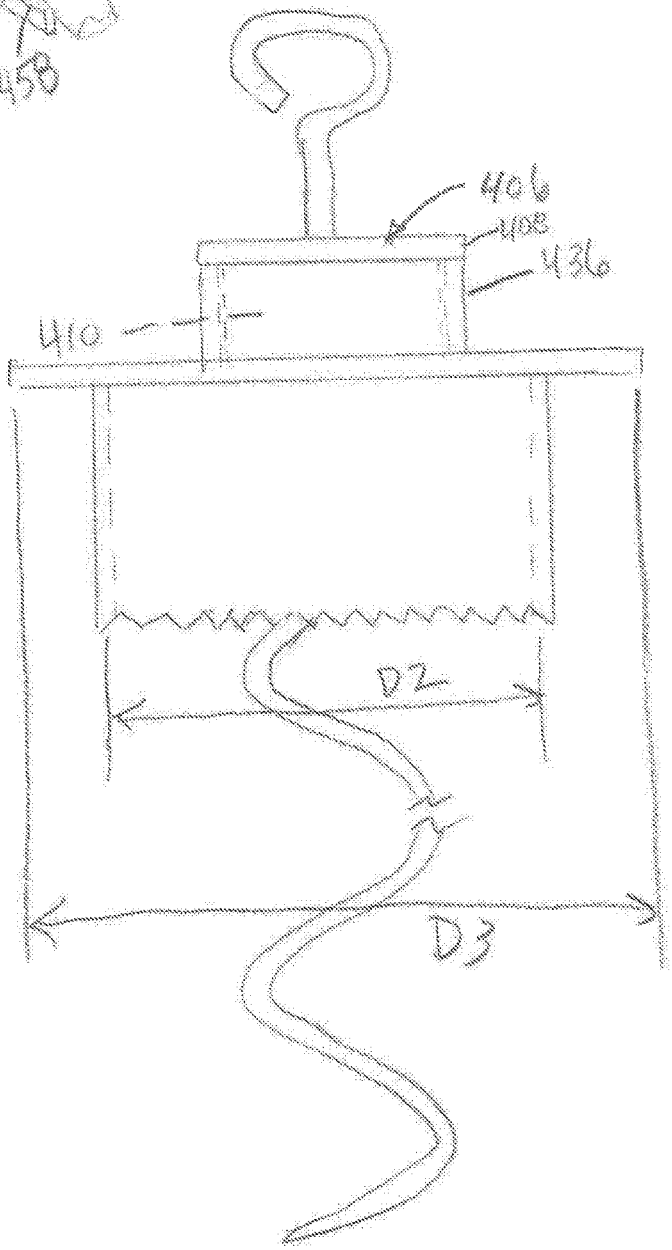
FIG. 11 is an elevation view of the further embodiment stake assembly of FIG. 10 in a second position.

FIGS. 10-12 show a further embodiment of a stake assembly 400. The spiral stake 150 of FIG. 2 is shown although the stake 102 shown in FIG. 1 could alternately be used. On the shaft in the straight section 108, there is the raised surface or side ears 114. A plastic plug 406 is mounted onto and around the ears 114 to fix the plug 406 onto the stake 150. The plug includes a top flange 408 and a lower plug body 410, formed together. The top flange 408 is a circular disk extending outward of the lower plug body 410. It is also possible that the stake and plug are formed together as a unitary piece.

Below the plug 406 is a cup 420 formed by a cylindrical sidewall 422 and substantially closed on the top by a plate 426. The cylindrical sidewall has an open bottom end 428. The end 428 can have circumferentially arranged teeth 429 that allow the rotation of the sidewall 422 to cut through vegetation or earth when rotated. The plate 426 includes an opening 430 for receiving the stake 150 therethrough. Above the opening is a socket 436 having a passage 438 the same size as, and in registry with, the opening 430. The opening 430 and passage 438 are sufficiently lame to allow the spiral stake to pass through without having to be screwed through the opening. The passage 438 is slightly larger in clearance or diameter to allow the lower plug body 410 to fit into the socket 436 but small enough that the top flange 408 of the plug 406 cannot fit through the passage 438. The socket 420, the plate 426 and the cylindrical sidewall 422 can be formed as a unitary piece.

FIG. 11 shows the installed position of the plug 406 into the socket 436 with the top flange 408 on top of the socket 436.

FIG. 12 shows one version of the plug 406. The lower plug body 410 is not a solid cylindrical body. Instead it is comprised of a central hub 458 and crossing ribs 460, 461, 462, 463 and 464. The use of ribs 460, 461, 462, 463 and 464 is effective to reduce the amount of plastic required while still allowing the lower plug body to extend deep into the socket 436. The ears 114 are molded into the central hub 458. The top flange 408 and the lower plug body 410 can be formed as a unitary piece.

Although other dimensions are encompassed by the invention, the following dimensions are useful. The length L of the lower portion of the stake 104, 156 can be about 7-12 inches long. The buried depth D1 (FIGS. 5 and 6) of the cup 120, 220, 420 can be 2-6 inches. The diameter D2 (FIGS. 4, 8 and 11) of the cylindrical sidewall 122, 222, 422 can be 2-4 inches. The diameter D3 (FIGS. 4 and 11) of the plate 126, 426 can be 3-6 inches, and larger than D2.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A stake assembly for providing an earth anchor, comprising:

a concave portion arranged facing the earth, wherein the concave portion has a top wall and a depending sidewall below the top wall, the sidewall enclosing a perimeter and having an open bottom end;

a stake portion comprising a helical shaft having a helical diameter, the helical shaft intended to be screwed into the earth, the stake portion engaged to the concave portion wherein the stake portion has a stop carried on an upper part of the shaft, and the top wall has a hole, wherein the hole is sized having a hole diameter greater than the helical diameter to allow the shaft to pass through the hole from above but not sized to allow the stop to pass through the hole; and the concave portion is arranged to capture earth therein when driven into the earth, the hole allowing the concave portion to be driven into the earth before the stake portion is installed and allows the stake portion to be removed while the concave portion remains in the earth;

wherein the concave portion comprises a cup having a cylindrical sidewall closed by the top wall having the hole for passing the stake portion, and the open bottom end, and the closed top wall comprises a socket, the hole defined by the socket and the stop is formed on a plug that is sized to fit into the socket when the stake portion is driven into the ground, wherein the plug has a discontinuous, substantially circular perimeter.

2. The stake assembly according to claim 1 wherein the depending sidewall has a longitudinal axis and the longitudinal axis is arranged at an oblique angle to the top wall.

* * * * *